US007168872B1

(12) United States Patent
Capps et al.

(10) Patent No.: US 7,168,872 B1
(45) Date of Patent: Jan. 30, 2007

(54) PRINTER PAPER SPOOLER WITH ERROR CONDITION DETECTOR

(75) Inventors: William R. Capps, Raleigh, NC (US); Thomas J. Howard, Cary, NC (US); Richard W. Vanderpool, III, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/335,124

(22) Filed: Jan. 19, 2006

(51) Int. Cl.
*B41H 75/00* (2006.01)

(52) U.S. Cl. ..... 400/242; 400/208; 400/207

(58) Field of Classification Search ..... 400/76, 400/61, 82, 207, 208, 208.1, 223, 242
See application file for complete search history.

(56) References Cited

U.S. PATENT DOCUMENTS

| | | | | |
|---|---|---|---|---|
| 3,917,142 A | | 11/1975 | Guarderas | 226/38 |
| 3,958,735 A | | 5/1976 | Wanat | 226/1 |
| 5,615,876 A | | 4/1997 | Yergenson et al. | 271/258.01 |
| 5,685,655 A | | 11/1997 | Del Signore, II et al. | 400/74 |
| 5,709,488 A | * | 1/1998 | Imai et al. | 400/234 |
| 5,713,059 A | | 1/1998 | Ishikawa | 399/18 |
| 5,725,321 A | | 3/1998 | Brannan et al. | 400/708 |
| 5,788,384 A | * | 8/1998 | Goodwin et al. | 400/208 |
| 5,879,092 A | | 3/1999 | Brannan et al. | 400/708 |
| 5,938,350 A | * | 8/1999 | Colonel | 400/234 |
| 7,018,119 B2 | * | 3/2006 | Koyabu | 400/242 |

FOREIGN PATENT DOCUMENTS

| | | |
|---|---|---|
| JP | 2192971 | 7/1990 |
| JP | 5186094 | 7/1993 |
| JP | 10245140 | 9/1998 |
| JP | 10265109 | 10/1998 |
| JP | 8169633 | 7/1999 |
| JP | 11277819 | 10/1999 |
| JP | 2000-079734 | 3/2000 |

* cited by examiner

*Primary Examiner*—Minh Chau
(74) *Attorney, Agent, or Firm*—Cantor Colburn LLP

(57) ABSTRACT

Disclosed is a printer paper spooler with error condition detector including a first slot structure and a second slot structure, a bobbin disposed between the first slot structure and the second slot structure, a light emitting diode, and a phototransistor that receives a detecting light beam emitted by the light emitting diode. Also included is a take-up reel that is powered by a take-up motor, associable with the bobbin via printed receipt paper, and disposed on a take-up tower. Further included is a base structure, on which the first slot structure, the second slot structure, and the take-up tower are disposed, and a spooler control program, associable via a data exchange connection with the phototransistor, the take-up motor, and a printer control program, which is associated with, and controls, a receipt paper printer that is printing the printed receipt paper.

7 Claims, 4 Drawing Sheets

PRINTER PAPER SPOOLER WITH ERROR CONDITION DETECTOR

FIELD OF THE INVENTION

This disclosure relates generally to a paper spooler, and more particularly to a printer paper spooler with the ability to detect printer error conditions.

BACKGROUND OF THE INVENTION

When a receipt paper printer is tested, one roll of receipt paper after another is fed through the printer (and printed) to test printer life. Throughout testing, these printers require consistent monitoring by a technician to detect and remedy failure conditions, such as paper jams, which are caused during the continuous feed of receipt paper. This monitoring is necessary because when paper jams occur, due to such issues as misalignment and overflow from the used paper bin, and/or excessive size of the paper roll on the paper take-up reel, the printer continues to print or attempt to print as if there was no issue. Damage to the printer platen or clutch can result if the printer continues to print or attempt to print during jam or any other error conditions. These jams must be discovered via the above mentioned technician monitoring because the printer has no way to determine that a jam has occurred.

There is, therefore, a need for a printer testing system that does not require constant monitoring by a printer-testing technician in order to detect unnecessary failure conditions, such as paper jams.

BRIEF DESCRIPTION OF THE INVENTION

Disclosed is a printer paper spooler with error condition detector that includes a first slot structure defining a first slot cavity and a second slot structure defining a second slot cavity, a bobbin disposed between the first slot structure and the second slot structure, wherein the bobbin includes a first extension that is configured to be associable with the first slot cavity and a second extension that is configured to be associable with the second slot cavity, a light emitting diode disposed on the first slot structure, and a phototransistor disposed on the second slot structure and positioned to selectively receive a detecting light beam emitted by the light emitting diode. Also included is a take-up reel disposed on a take-up tower and powered by a take-up motor, wherein the take-up reel is associable with the bobbin via printed receipt paper supplied by a receipt paper roll. In addition, the printer paper spooler with error condition detector further includes a base structure, including a base parallel port, on which the first slot structure, the second slot structure, and the take-up tower are disposed, and a spooler control program, associable via a data exchange connection with the phototransistor, the take-up motor, and a printer control program, wherein the printer control program is associated with a receipt paper printer that is printing the printed receipt paper supplied by the receipt paper roll, and wherein the printer control program controls operation of the receipt paper printer.

BRIEF DESCRIPTION OF THE FIGURES

The foregoing and other features and advantages of the present invention should be more fully understood from the following detailed description of illustrative embodiments taken in conjuncture with the accompanying Figures in which like elements are numbered alike in the several Figures.

DETAILED DESCRIPTION

Figure 1:
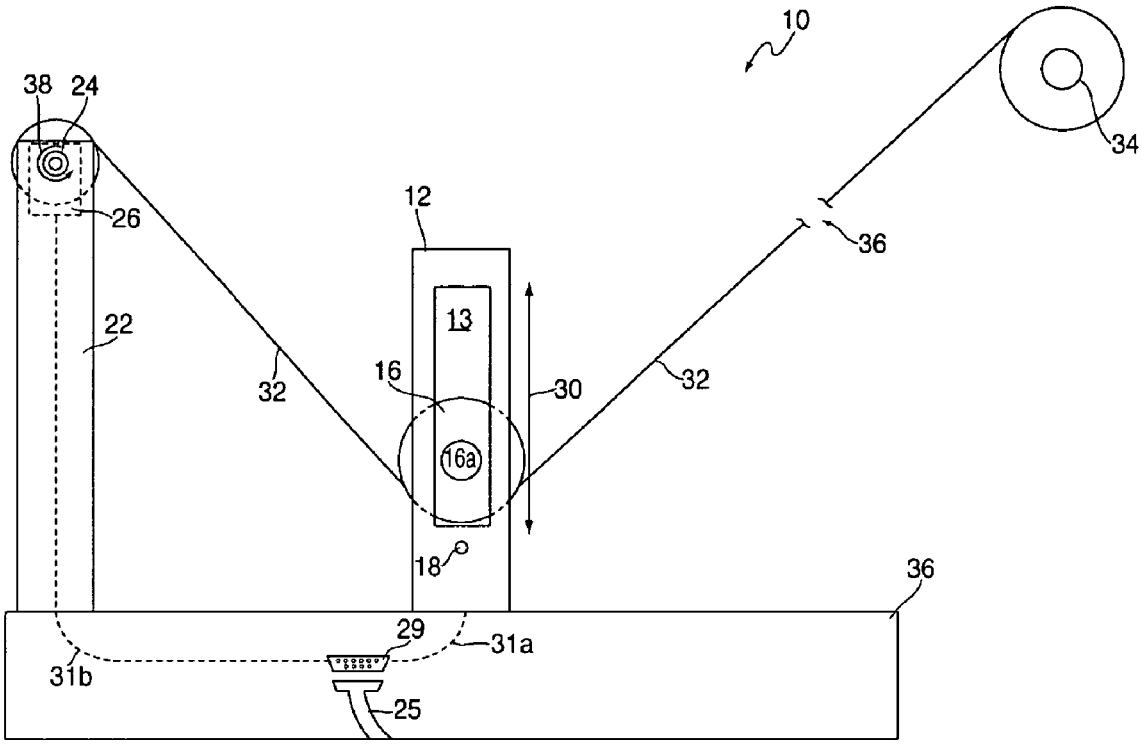
FIG. 1 is a side elevation view of a printer paper spooler with error condition detector from a first slot structure side.
Figure 2:
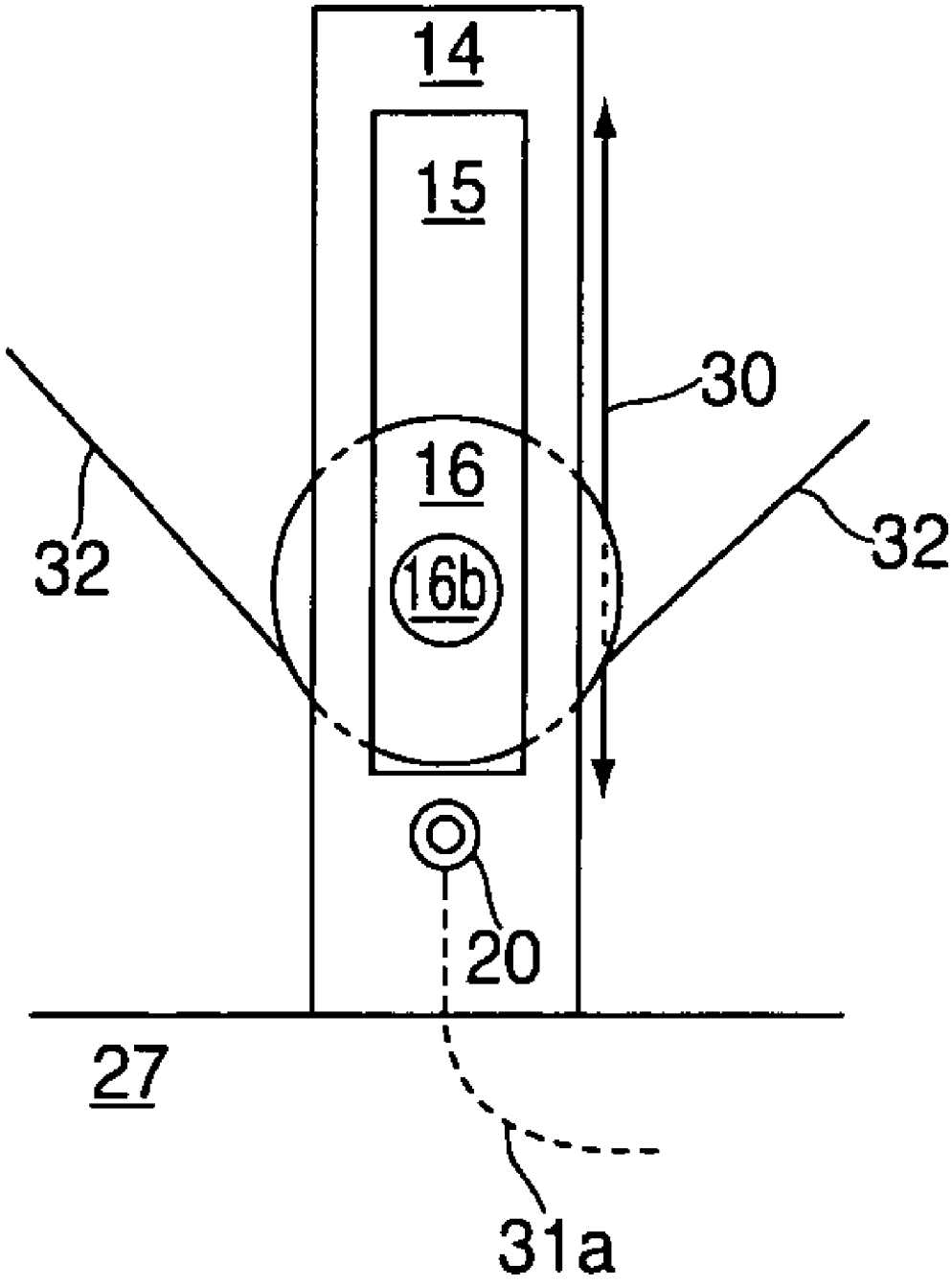
FIG. 2 is a side elevation view of a portion the printer paper spooler with error condition detector from a second slot structure side.
Figure 3:
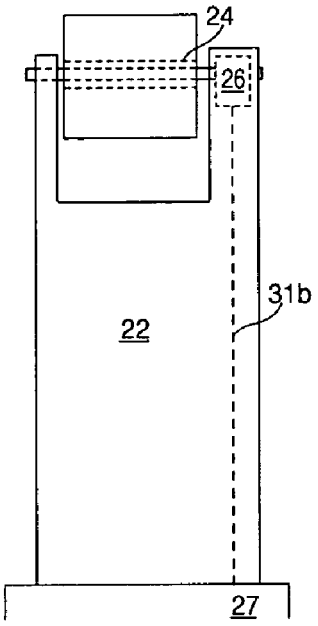
FIG. 3 is an end elevation view of a take-up tower end of the printer paper spooler with error condition detector of FIG. 1.

Referring to FIGS. 1–5 simultaneously, a printer paper spooler with error condition detector 10 is illustrated. The printer paper spooler with error condition detector 10 spools printed receipt paper and detects receipt paper printer error conditions, such as paper jams, without the need for continuous monitoring by a printer-testing technician. The printer paper spooler with error condition detector 10 includes a first slot structure 12 including a light emitting diode (LED hereinafter) 18 and defining a first slot cavity 13, and a second slot structure 14 including a phototransistor 20 and defining a second slot cavity 15. Also included are a bobbin 16, including a first extension 16*a* and a second extension 16*b*, and a take-up tower 22, including a take-up reel 24 and a take-up motor 26. The first slot structure 12, the second slot structure 14, and the take-up tower 22 are disposed on a base structure 27, which includes a base parallel port 29 and data wiring (illustrated in the figures as data wiring 31*a* and 31*b*). Further included is a spooler control program (not illustrated) that is associable with the phototransistor 20, take-up motor 26, and a printer control program via a data exchange connection. The spooler control program and printer control program are included in at least one of a server and a personal computer (neither illustrated), which includes a server parallel port (not illustrated) and is associable with the base structure 27 via a cable 25.

The first slot structure 12 is associable with the second slot structure 14 via the bobbin 16 and a detecting light beam 28 emitted from the LED 18 and extending to the phototransistor 20, which is positioned on the second slot structure 14 to selectively detect and receive the detecting light beam 28. The bobbin 16 is disposed between the first slot structure 12 and second slot structure 14, and held therein via associations between the first extension 16*a* and the first slot cavity 13 and the second extension 16*b* and the second slot cavity 15. Each extension 16*a*–*b* is configured to be associable with its corresponding slot cavity (13 and 15 respectively) via an actuating device (not illustrated), such as a spring, disposed within the bobbin 16 and/or extensions 16*a*–*b*. These actuating devices allow the extensions 16*a*–*b* to be pushed, against the force of the actuating device/spring, inwardly towards the bobbin 16, wherein the extensions 16*a*–*b* will re-extend after pushing ceases, and may enter the slot cavities 13 and 15 upon this re-extension. Once associated with the slot cavities 13 and 15 via the extensions 16*a*–*b*, the bobbin 16 may traverse a length 30 of the slot cavities 13 and 15 in response to forces that will be discussed in greater detail below.

The bobbin 16, and thus the first slot structure 12 and second slot structure 14, are associable with the take-up reel 24, and thus take-up tower 22, via printed receipt paper 32. The printed receipt paper 32 is supplied by a receipt paper roll 34 and becomes printed by traveling through a receipt paper printer (printer hereinafter). This printer may be any receipt paper printing mechanism suitable to the desired end purpose of printing on receipt paper. The printer is represented in FIG. 1 at printer area 36 (not illustrated to actually contain a printer in the illustration), and it should be appreciated that all paper emerging from a side of the printer area 36 closest to the bobbin 16 is the printed receipt paper 32 in FIG. 1.

Referring back to the association between the take-up reel 24 and the bobbin 16, the take-up reel 24, which is powered by the take-up motor 26, revolves as shown at revolution direction 38, and pulls/takes-up the printed receipt paper 32 from the printer area 36, under the bobbin 16 (to which it is contacting), and onto the take-up reel 24. By "taking-up" excess paper onto the take-up reel, printed receipt paper 32 does not does not have to be caught in trash bins from which the paper may overflow and interfere with the printing process.

As was briefly mentioned above, the base structure 27 serves as a base for the slot structures 12 and 14 and the take-up tower 22, and is associable with at least one of the personal computer and the server (for simplicity purposes, "at least one of the personal computer and the server" will be referred to as the server hereinafter), which is also associable with the printer (represented in the illustrations at printer area 36). The server is associable with the base structure 27 via the cable, which is connectable to the base parallel port 29 and the server parallel port, thus extending from the base structure 27 to the server. The data wiring 31*a* (briefly introduced above) connects the base parallel port 29 with the phototransistor 20, and transports phototransistor data (i.e. whether or not the detecting light beam 28 emitted by the LED 18 is reaching and being detected by the phototransistor 20) from the phototransistor 20 to the base parallel port 29. The phototransistor data may then be transported from the base parallel port 29 to the server parallel port via the cable, wherein the server includes the spooler control program (briefly mentioned above) that deciphers the phototransistor data. The spooler control program may then create resultant data from the phototransistor data, and transport the resultant data from the server parallel port to the base parallel port 29 via the cable 25, and/or transport the resultant data to another program within the server such as a WINIOTEST type program or other printer control program that can control printer operation. Resultant data transported to the base parallel port 29 is further transported to the take-up motor 26 via the data wiring 31*b* (also briefly introduced above), wherein the resultant data will control take-up motor 26 function (which will also be discussed in greater detail below). It should be appreciated the data wiring 31*a* and 31*b* may be associated with a circuit board that is also disposed within the base structure 27, wherein the circuit board aids in producing the phototransistor data and deciphering the resultant data. The data wiring 31*a–b*, base parallel port 29, server parallel port, and cable 25 achieve the data exchange connection between the spooler control program and the phototransistor 20 and take-up motor 26.

Figure 5:
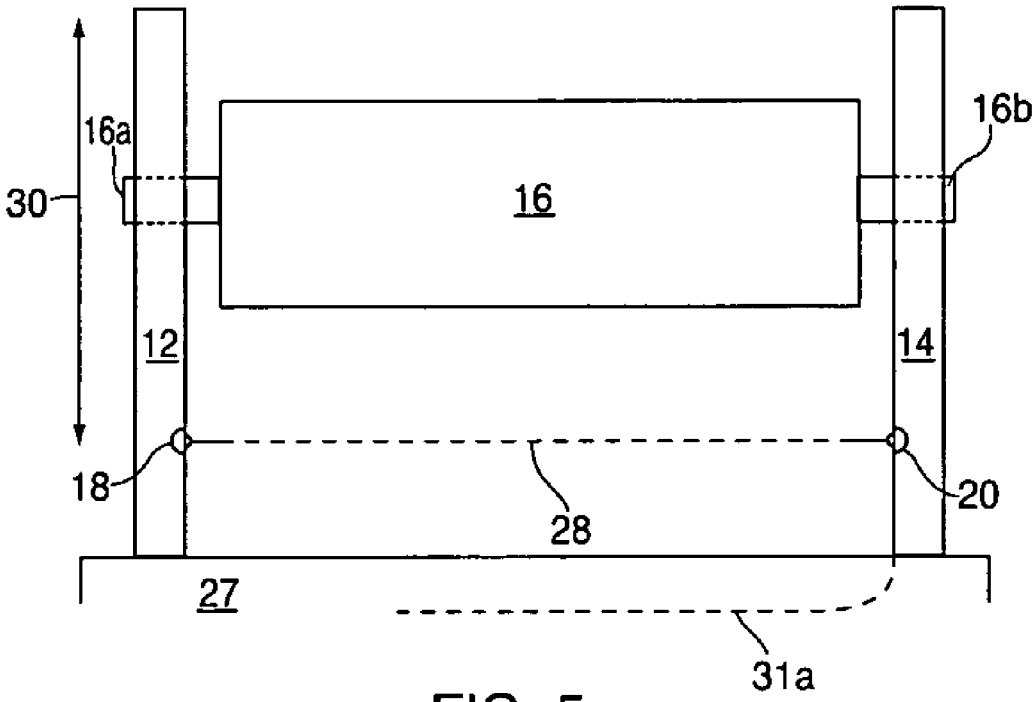
FIG. 5 is the end elevation view of FIG. 4, with the bobbin disposed outside of the detecting light beam.

With the components of the printer paper spooler with error condition detector 10 sufficiently introduced, the manner in which the printer paper spooler with error condition detector 10 detects and alleviates error conditions may now be discussed. Referring particularly to FIG. 1 and FIG. 5, the bobbin 16 will rest in the path of the detecting light beam 28 until the take-up motor 26 activates the rotation of the take-up reel, typically at the start of the printing process. Once this activation takes place, the bobbin 16 will be positioned outside of the detecting light beam 28 during most printing conditions. This is because the take-up reel 24 causes tension within the printed receipt paper 32, creating a force in the printed receipt paper 32 that holds the bobbin 16 above the detecting light beam 28.

Figure 4:
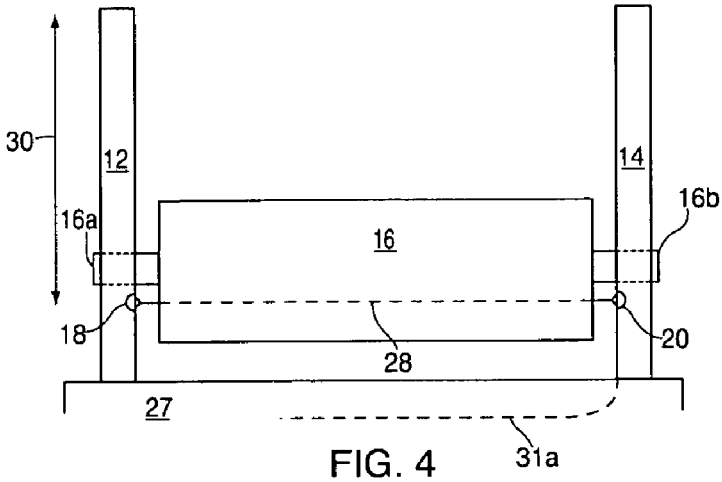
FIG. 4 is an end elevation view of a slot section end of the printer paper spooler with error condition detector of FIG. 1 without receipt printer paper, including a bobbin disposed in a detecting light beam.

An error condition would occur if the receipt paper roll 34 were to run out of receipt paper, causing the taught printed receipt paper 32 that holds the bobbin 16 above the detecting light beam 28 to also run out, resulting in the bobbin 16 to falling into the detecting light beam 28, as shown in FIG. 4. With the detecting light beam 28 interrupted by the presence of the bobbin 16, the phototransistor 20 passes this phototransistor data (about the interrupted detecting light beam 28) through the data wiring 31*a*, to the base parallel port 29, into the cable 25, and ultimately to the spooler control program in the server. The spooler control program will then recognize this data, and take action if the detecting light beam 28 remains interrupted for an amount of time preprogrammed into the spooler control program. Once this time threshold is reached (the time threshold may be varied within the spooler control program), the spooler control program will send resultant data, to the printer control program, wherein the resultant data signals the error condition and instructs the printer control program to stop the printing process. By instructing this printing stoppage upon exhaustion of the receipt paper supply, a truer test of printer life can be achieved, while preventing damage to the printer paten and clutch. It should be appreciated that the spooler control program will also send the resultant data to the take-up motor 26 (via the cable 25, base parallel port 29, and data wiring 31*b*), instructing the take-up motor 26 to also cease operation, saving take-up motor 26 life. It should be further appreciated that the bobbin 16 would also fall into the detecting light beam 28, causing the same spooler control program reaction, if the take-up reel 24 became to full. This is because a full take-up reel 24 would stop revolving, eliminating tension in the printed receipt paper 32 and causing the bobbin 16 to fall.

Another error condition would occur if there were a paper jam in the printer at the printer area 26. A paper jam could cause one of two bobbin 16 reactions. Referring to a first reaction caused by a paper jam, the revolving of the take-up reel 24 and the resulting tension in the printed receipt paper 32 (which is now jammed and no longer moving toward the take-up reel 24) could cause the bobbin 16 to rise to the respective top of the length 30 of the slot cavities 13 and 15, and produce a force/tension great enough to tear the printed receipt paper 32. This tear would cause the bobbin 16 to fall into the detecting light beam, which would ultimately result in the spooler control program and printer control program stopping operation of the take-up motor 26 and printer, just as they did in the receipt paper roll 34 exhaustion error condition discussed above.

Referring to a second reaction caused by a paper jam, the revolving of the take-up reel again causes the bobbin 16 to rise to the respective top of the length 30 of the slot cavities 13 and 15, but in this second scenario, there is not enough force/tension to cause the printed receipt paper 32 to tear. If the paper does not tear, the bobbin 16 will remain held at the respective top of the length 30, outside of the detecting light beam 28. With the detecting light beam 28 thus continuously uninterrupted, the phototransistor 20 would pass this phototransistor data (about a continuous uninteruption) through the data wiring 31*a* to the base parallel port 29, into the cable 25, and ultimately to the spooler control program in the server. The spooler control program will then recognize this data, and take action if the detecting light beam 28 remains uninterrupted for an amount of time pre-programmed into the spooler control program. Once this time threshold is reached (the time threshold may also be varied within the spooler control program, though likely set to correspond with a little more than the amount of time it takes for an entire receipt paper roll 34 to be exhausted), the spooler control program will send resultant data to the printer control program, wherein the resultant data signals the error condition and instructs the printer control program to stop the printing process. By instructing this printing stoppage, in this case because of a paper jam, damage to the printer platen and clutch can be prevented by alleviating the printer's attempts to print during jam conditions. It should be appreciated that the spooler control program will also send the resultant data to the take-up motor 26 (via the cable 25, base parallel port 29, and data wiring 31*b*), instructing the take-up motor 26 to also cease operation, saving take-up motor 26 life.

It should also be appreciated, separate from alleviation of error conditions, that the spooler control program may be set to increase power to the take-up motor 26 as the bobbin's 16 time outside of the detecting light beam 28 increases. This will allow power to the take-up motor 26 to increase as the roll of printed receipt paper 32 around the take-up reel 24 grows. Thus, the amount of power required to turn a small roll will correspond with the amount of power supplied to the take-up motor 26 during the initial stages of the process (with power increased only as the roll grow larger at the end of the process), saving take-up motor 26 power.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A printer paper spooler with error condition detector comprising:

a first slot structure defining a first slot cavity and a second slot structure defining a second slot cavity;

a bobbin disposed between said first slot structure and said second slot structure, wherein said bobbin includes a first extension that is configured to be associable with said first slot cavity and a second extension that is configured to be associable with said second slot cavity;

a light emitting diode disposed on said first slot structure;

a phototransistor disposed on said second slot structure and positioned to selectively receive a detecting light beam emitted by said light emitting diode;

a take-up reel disposed on a take-up tower and powered by a take-up motor, wherein said take-up reel is associable with said bobbin via printed receipt paper supplied by a receipt paper roll;

a base structure, including a base parallel port, on which said first slot structure, said second slot structure, and said take-up tower are disposed; and a spooler control program, associable via a data exchange connection with said phototransistor, said take-up motor, and a printer control program, wherein said printer control program is associated with a receipt paper printer that is printing said printed receipt paper supplied by said receipt paper roll, and wherein said printer control program controls operation of said receipt paper printer.

2. A printer paper spooler with error condition detector according to claim 1, wherein said base structure is associable with at least one of a personal computer and a server including said spooler control program, said printer control program, and a server parallel port, wherein said data exchange connection between said spooler control program and said phototransistor and said take-up motor is achieved via a cable that is connectable to said server parallel port and said base parallel port, and data wiring which connects said take-up motor and said phototransistor with said base parallel port, wherein said data wiring transports phototransistor data from said phototransistor to said base parallel port, and wherein said data wiring transports resultant data from said base parallel port to said take-up motor.

3. A printer paper spooler with error condition detector according to claim 2, wherein at least one of said personal computer and said server are associated with said receipt paper printer.

4. A printer paper spooler with error condition detector according to claim 3, wherein said cable transports phototransistor data from said base parallel port to said server parallel port.

5. A printer paper spooler with error condition detector according to claim 4, wherein said phototransistor data is decipherable by a spooler control program included in at least one of said personal computer and said server.

6. A printer paper spooler with error condition detector according to claim 5, wherein said spooler control program creates said resultant data from said phototransistor data, wherein said resultant data is transportable to said take-up motor via said server parallel port, said cable, said base parallel port, and said data wiring, and is also transportable via said data exchange to said printer control program that controls operation of said printer.

7. A printer paper spooler with error condition detector according to claim 6, wherein said printer control program controls operation of said printer based on said resultant data from said spooler control program.

* * * * *